United States Patent [19]

Oppenheimer

[11] 4,034,991

[45] July 12, 1977

[54] SWING TRAINING APPARATUS

[76] Inventor: Jess Oppenheimer, 549 Moreno Ave., Los Angeles, Calif. 90049

[21] Appl. No.: 627,301

[22] Filed: Oct. 30, 1975

Related U.S. Application Data

[63] Continuation-in-part of Ser. No. 452,231, March 18, 1974, Pat. No. 3,917,281.

[51] Int. Cl.[2] ..... A63B 69/36

[52] U.S. Cl. ..... 273/186 A; 273/191 B; 35/29 A; 273/26 R

[58] Field of Search ..... 273/186 R, 186 A, 191 R, 273/191 A, 191 B, 192, 26 B; 272/124, 117, 118; 35/29 A

[56] References Cited

U.S. PATENT DOCUMENTS

| | | | |
|---|---|---|---|
| 1,137,349 | 4/1915 | Patterson | 273/191 R |
| 1,567,530 | 12/1925 | MacNaughton et al. | 273/191 A |
| 1,983,920 | 12/1934 | Perin | 273/191 R |
| 2,134,451 | 10/1938 | Mogren | 272/117 |
| 3,319,963 | 5/1967 | Cockburn | 273/186 R |
| 3,376,037 | 4/1968 | Lepselter | 273/26 B |
| 3,604,712 | 9/1971 | Lansing et al. | 273/186 R |
| 3,917,281 | 11/1975 | Oppenheimer | 273/191 A X |

*Primary Examiner*—George J. Marlo
*Attorney, Agent, or Firm*—Nilsson, Robbins, Dalgarn & Berliner

[57] ABSTRACT

Apparatus for use by one manipulating a device to be swung such as a golf club, bat or the like. A weighted member such as a slider is secured to another member for guiding the slider through a pre-determined path, such for example, as an arcuate guide member. A pair of flexible cords are secured to a pair of spaced apart posts and engage both the slider and the device to be swung with one of the cords secured at its other end to the device to be swung and the other to the slider. As the user swings the device to be swung, such as a golf club, the slider is caused to traverse the pre-determined path causing the flexible cords to become taut or slack at pre-determined points throughout the swing, thereby causing the device to be swung to accelerate at a maximum speed through a desired point and to assume a desired position while moving at the maximum speed. Thus both timing and power are developed for the swing. One of the cords may have a rigid rod-like member substituted for it with one end of the rod secured to the weighted member or slider and with the rod passing through a ring or loop secured to the device to be swung. Also disclosed is apparatus where the cords may pass through a stop means and over a pulley or the like to a position for attachment to the shoulders of the user. Thus as the user swings the device his shoulders are automatically placed into the proper positions as required to accommodate the particular swing.

Also disclosed as an alternative to the arcuate guide member and slider is an elongated rod supported for rotation about a pivot point and having a universally attached ring member thereon which is engaged by the flexible cords.

10 Claims, 10 Drawing Figures

SWING TRAINING APPARATUS

REFERENCE TO OTHER APPLICATION

This application is a continuation in part of U.S. patent application Ser. No. 452,231 filed Mar. 18, 1974 and entitled SWING TRAINING APPARATUS now U.S. Pat. No. 3,917,281.

BACKGROUND OF THE INVENTION

This invention relates to swing training devices and more particularly to devices adapted specifically to enable the user of the swing device to develop accurate timing and maximum power and thus to generate maximum speed thereof at a pre-determined desired point in the swing.

The present invention is useful with any device to be swung by a user such as in playing the games of softball, baseball, golf, bowling or the like. However, for purposes of clarity of illustration and ease of description and understanding, the apparatus of the present invention will be described principally in conjunction with the utilization thereof in a golf swing and incidentally in the baseball swing.

In any swing, and particularly in a golf or baseball swing, there is a great tendency for the player to uncock his wrists too early or too late in the swing thereby precluding development of maximum club head to bat speed at the point of impact with the ball. If the wrists are uncocked too early in the swing, a principal portion of the power available to generate maximum speed of the club head or bat has been dissipated prior to the point of impact. Alternatively, if the wrists are uncocked too late the power is applied to the club head or bat after contact with the ball and thus does not contribute to movement of the ball as desired. Such would be normally referred to as a "guiding" or hitting with stiff wrists. Many attempts have been made in the past to instruct users in proper swing technique, thereby to enable development of the proper timing and application of power so as to develop maximum club head speed at the point of impact. However there is no prior art apparatus or teaching known to Applicant which brings the club head to the point of impact with correct positioning while at the same time producing maximum club head speed at that desired point. The closest prior art known to Applicant are U.S. Pat. Nos. 1,137,349; 1,536,512, 2,103,502; 2,520,287; 3,301,561; 3,339,927; 3,462,156; 3,703,294.

SUMMARY OF THE INVENTION

A swing training apparatus for perfecting timing of a device to be swung by a user thereof including a weighted member engaging means for directing the same through a pre-determined path as the device is swung. First and second means engage the member and the device for respectively positioning the device in the proper attitude and for applying a force to the device during the power portion of the swing to thereby enable maximum speed for the device at the desired point and to position the same in the proper attitude. The first and second means are connected with the device to effectively release the device during that portion of the swing where maximum speed is attained but while remaining in physical engagement therewith.

DESCRIPTION OF THE VARIOUS EMBODIMENTS

Figure 1:
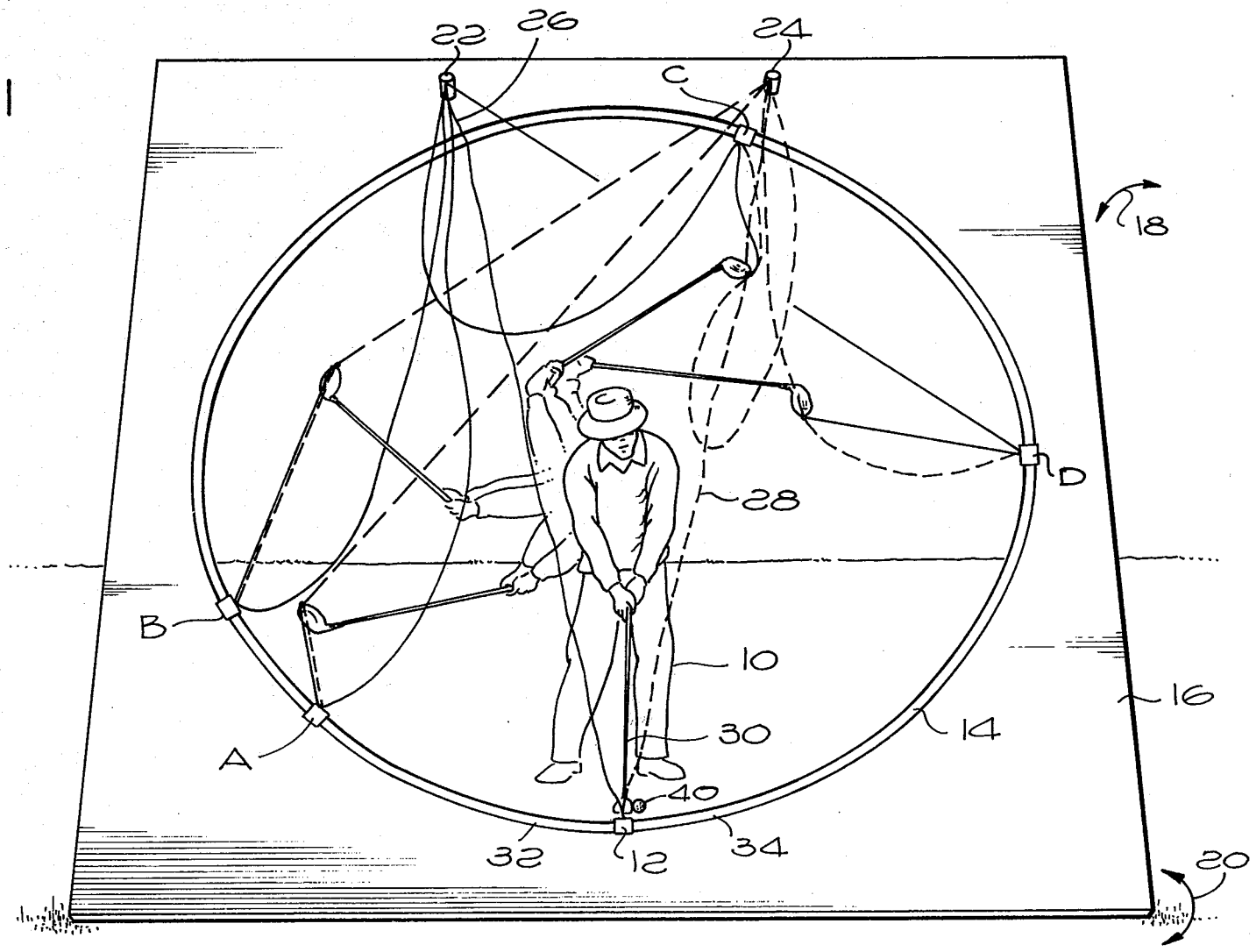
FIGS. 1 through 4 are schematic illustrations of a golfer at various positions in a swing while utilizing apparatus in accordance with the present invention.

Referring now to FIGS. 1 through 4 and more specifically to FIG. 1 there is disclosed an apparatus constructed in accordance with the principles of the present invention and illustrated as being in use by a golfer 10. As the golfer 10 swings the golf club 30 through the normal golf swing, the club head will be caused to accelerate to a maximum speed and will be caused to assume the correct hitting position at the point of impact with the golf ball. The apparatus includes a weighted member such as a slider 12 which engages means for causing the slider to traverse a pre-determined path such as a guide means 14. The guide means 14 is shown as supported on a large frame 16 which may be tilted forward and backward as indicated by the arrow 18 to accomodate a particular swing plane as may be desired. The frame 16 may also be moved as illustrated by the arrow 20 to provide for the desired line of flight and movement of the club head with respect thereto as is known to those skilled in the art. Appropriate support and adjusting mechanisms known to those skilled in the art will be incorporated with the apparatus as illustrated but none are shown herein to facilitate and clarify illustration and description.

The apparatus as disclosed in accordance with one embodiment of the present invention also includes a pair of securing posts 22 and 24 which are disposed in a spaced apart relationship upon the frame 16. The posts 22 and 24 need not be on the frame 16 but in fact may be separated therefrom and positioned at any desired point. Connected to the post 22 is a cord 26 while connected to the post 24 is a cord 28. The cords 26 and 28 engage the device to be swung such as the golf club 30 and the slider 12. Preferably the cord 26 passes through the slider and is then attached to the golf club 30 at a point displaced from the grip area thereof such as at the toe of the club. As would be recognized by those skilled in the art an appropriate ring or hook (not shown) is attached to the slider and to the club 30 for accomodation of the cord 26. The cord 28 on the other hand passes first through a ring on the club head of the golf club 30 and then is secured to a ring on the slider 12.

It will be particularly noted that at the address position as shown in the illustration of FIG. 1 both of the cords 26 and 28 are slack; that is, neither cord applies any force to the slider 12 nor do they exert any pull on the golf club 30. However by an investigation of the illustration it will be recognized that if the golf club 30 is moved from the address position, either forward or backward of the golfer a short distance, each of the cords will become individually taut at a pre-determined position such for example as at 32 and 34. That is if the club head of the club 30 is moved to the golfers right to the point shown at 32 the cord 28 will become taut. On the other hand if the club head is moved to the point 34 at the golfer's left the cord 26 will become taut. In between the points 32 and 34, both of the cords 26 and 28 are slack to a greater or lesser degree. This feature will become more fully appreciated during the description of the use of the apparatus which follows. The apparatus has been illustrated throughout with the cord 28 shown in a broken line and the cord 26 in a solid line. By such illustration it is believed that it will be much easier to follow the particular condition of the cords throughout the swing in the following description thereof.

The Backswing

In FIG. 1 the various positions occupied by a golfer in the backswing are illustrated and with each position the condition of the cords 26 and 28. Thus it will be noted as the golfer initially moves into the takeaway position at the beginning of the backswing the cords 26 and 28 each will apply a force to the slider 12 and commence it moving toward the golfer's right. Almost immediately, slack will develop in the cord 26 and the cord 28 will become taut. Thus, as is shown in the first position A the cord 28 is taut and is applying a pull to the slider 12 to cause it to move to the golfer's right and upwardly along the guide 14. Likewise at the position shown at B the cord 28 is still in its taut position while the cord 26 is even more slack than previously. By imparting movement to the slider 12 in the backswing movement the slider is caused to traverse around the guide 14 through the position shown at C wherein both cords 26 and 28 are slack to a position at D where the cord 26 has become taut and has stopped the movement of the slider 12 in the position shown. As is noted, the cord 28 is now in a slack position. The golfer in the position D has assumed the classical top of the backswing position and club attitude. The movement of the slider D to this position and coming to a rest also will tend to cause the golfer to hesitate slightly at the top of the backswing thus positioning himself for a powerful downswing as is desired and as is well known in the art.

The Downswing

Figure 2:
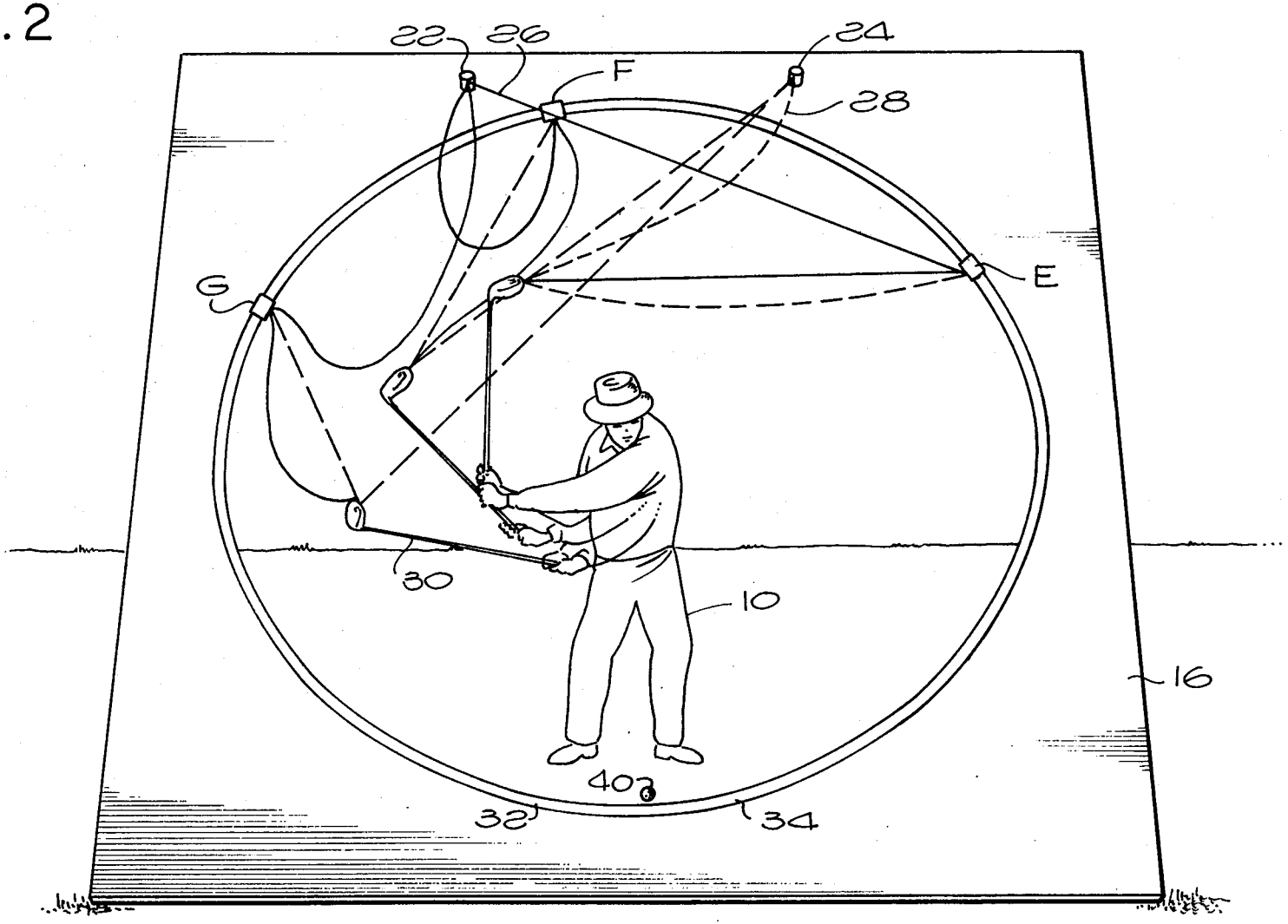

Referring now to FIGS. 1 and 2 and particularly to FIG. 2 the downswing of the golfer is more fully illustrated. As the golfer moves from the position D as shown in FIG. 1 to the positions E, F and G shown in FIG. 2 it will be noted that the golfer has basically moved the lower part of his body and his shoulders and arms into a position where the wrists remain cocked and the hands are in a position to roll over or release and thus apply power in the swing by causing the club head to generate maximum speed. At the beginning of the downswing when the golfer moves from the position D of FIG. 1 to the position E of FIG. 2 the cord 26 is taut and applies force to the slider 12 causing it to commence to follow a pre-determined path along the guide 14 in a direction opposite to that which it followed during the backswing. As the force is generated and the slider moves along the guide the cord 28 becomes taut and the cord 26 becomes slack. It is noted that as a result of the tautness of the cord 28 through the principal portion of the downswing a force is being applied to the slider 12 through the manipulation of the club head by the golfer thus causing the slide to accelerate along the guide 14. As the slider accelerates in conjunction with the acceleration of the club head the cord 28 between the club head and the slider becomes shorter and shorter until the point 32 is reached which is the entry of the club into the impact zone.

The Impact Zone

Figure 3:
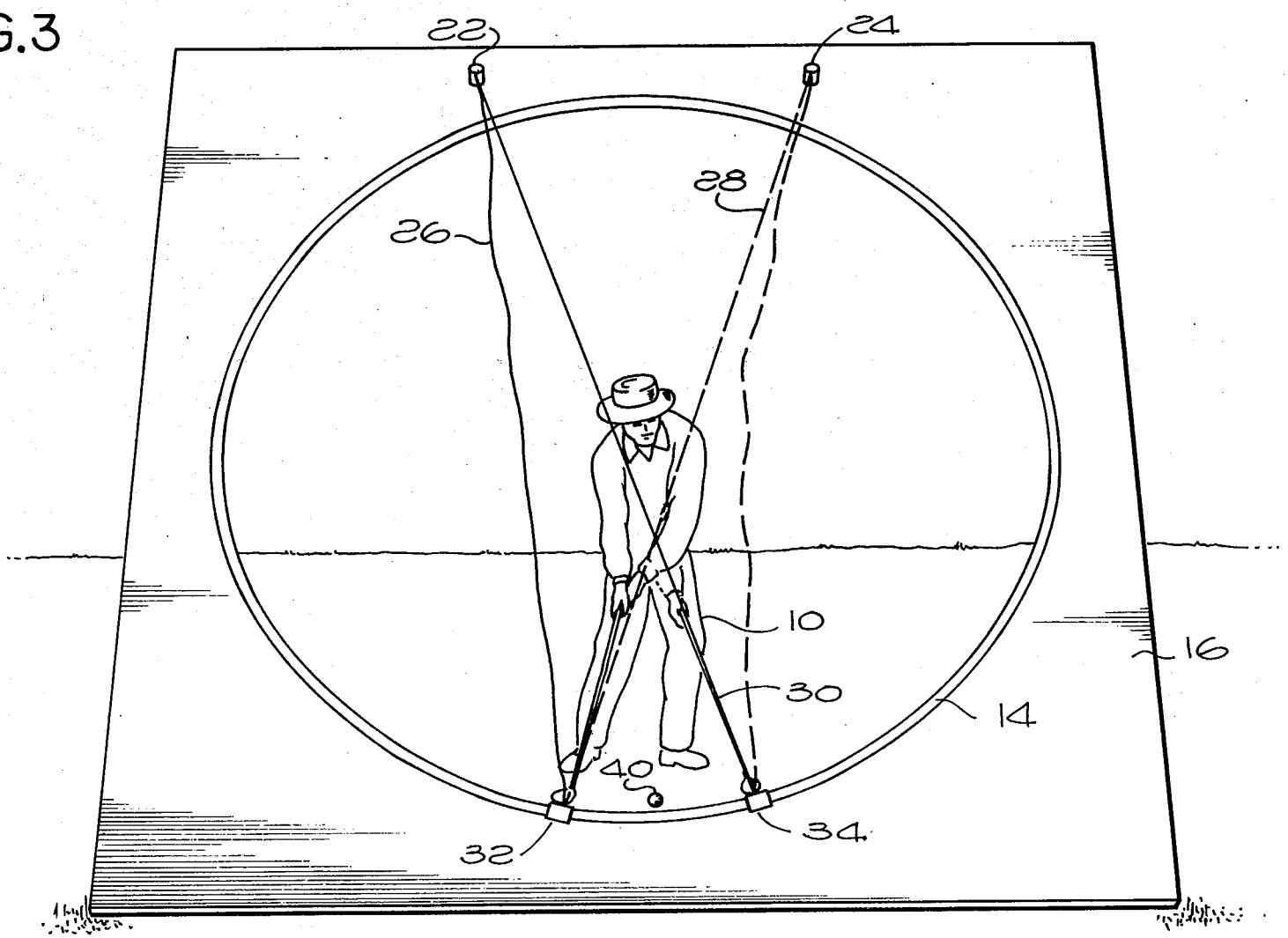

By reference now more specifically to FIG. 3 the impact zone is specifically illustrated. As the slider 12 enters the impact zone at 32 the cord 28 is taut and as a result of the interconnection between the slider and the club head, the club head has been brought into the desired position adjacent the slider to cause the club to travel through the impact zone and strike the ball 40. As the club head enters the impact zone at 32 the cord 26 is slightly slack but is beginning to become taut. As the cord 26 becomes more taut, the club head, as a result of the particular interconnection between the club head and the cord, in conjunction with the slider, is caused to assume the desired position to cause appropriate contact of the face of the club with the ball 40. As was previously pointed out, as the slider passes from position 32 to position 34 both of the cords develop slack and the club head, assuming that the club head and the slider are now traveling at the same speed, is free to move through the actual impact with the ball 40 as a "ballistic missile". The position of the club head with respect to the slider 12 is insured through the utilization of the cords 26 and 28 along with the slider 12 and by positioning the points of anchoring of the two cords 26 and 28 as is illustrated. That is, as the downswing is performed as is illustrated in FIG. 2 the constant pull exerted by the club head through the cord 28 on the slider 12 causes the slider 12 to move faster and faster. As the slider 12 reaches the point 32 and as a result of the tautness of the cord 28 at this point the club head will be pulled into this position as a result of forces generated by the slider against the club in the event that the golfer has tended to fail to release his hands. Another way of stating the same point is that if the golfer as he approaches the entry to the impact zone is slow in uncocking his wrists or releasing his hands the forces applied by the now very fast moving slider to the club head through the taut line 28 will cause the club head to move faster and thus force the golfer to begin to uncock his wrists and allow the hands to release much more quickly. At the same time such action will cause the club head to assume the proper position at the point of impact by the cord 26 becoming taut. This type of action effectively pulls the club head through the ball. In the event the golfer has attempted to uncock his wrists too early in the swing, the pull against the slider will be felt thus indicating to the golfer that he is attempting to accelerate the club head too quickly and too early in the downswing and thus will retard the golfers uncocking of the wrists at this point in time. That is, the properly timed uncocking of the wrists is insured by the proper correlation of the speed of the slider 12 with the speed of the club head has the club enters the impact zone as shown at 32. It is noted at the point 34 the cord 26 is now taut with the cord 28 slack. Thus the club head through maintenance of the tautness of the cord 26 through to the point 34 and beyond assures that the club head has been swept completely through the impact zone in a position immediately adjacent the slider 12 and with the face of the club positioned appropriately to properly strike the ball 40 causing it to travel through the desired line of flight. To again emphasize if the club head is moving at the appropriate speed and with the slider through the impact zone between the points 32 and 34 the club will have no forces exerted thereon by the cords 26 and 28 and thus will be traveling effectively as a "ballistic missile". It will also be noted that even though the slider 12 may be traveling on a curved path (although such is not necessary) defined by the guide 14 the club may in fact be traveling on a straight path through the ball 40.

The Followthrough

Figure 4:
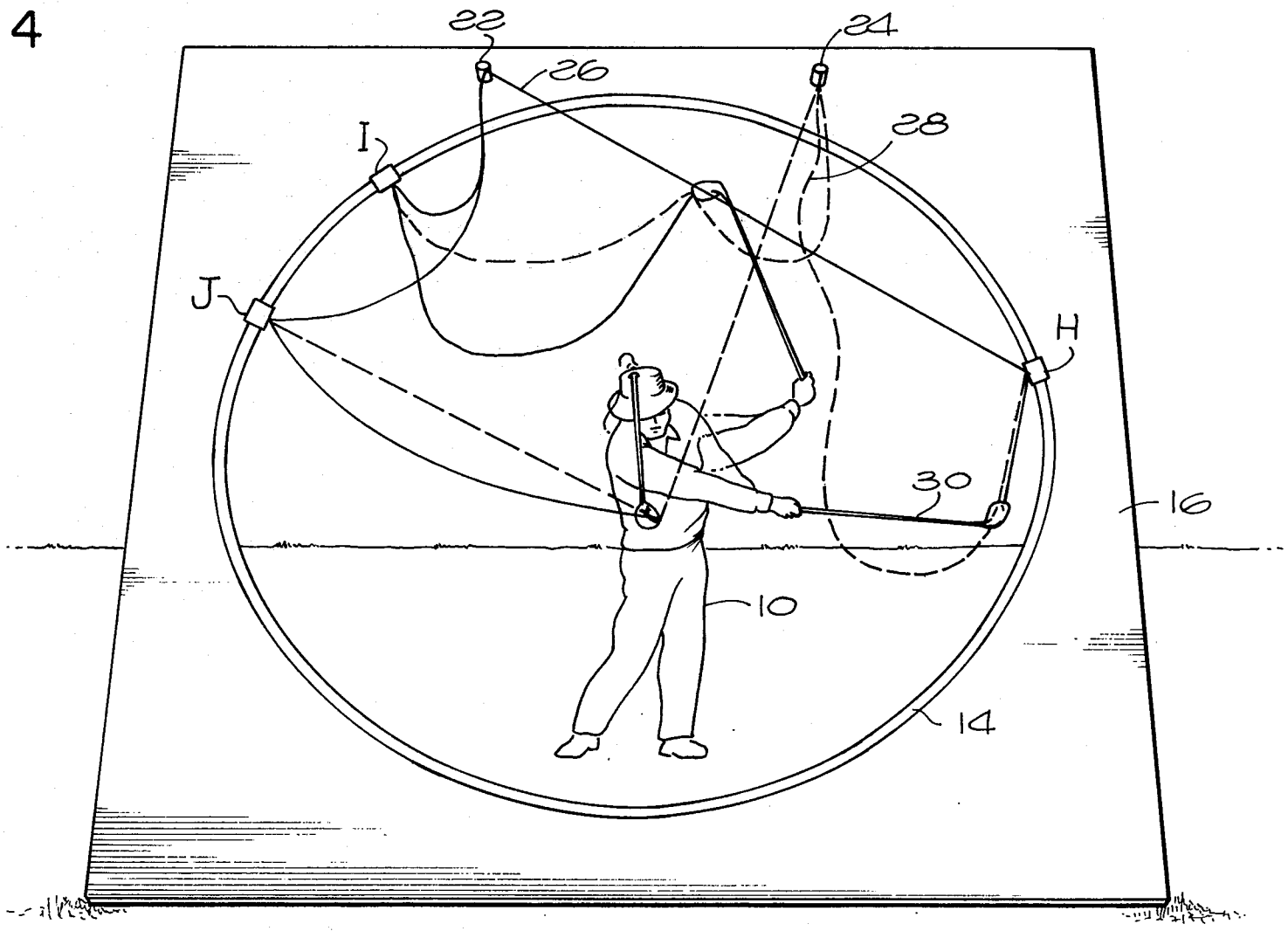

As is illustrated more particularly in FIG. 4 the completion of the swing or the followthrough is more fully illustrated. As is shown, the slider travels through the Position H maintaining the cord 26 taut while the cord 28 is slack. As the slider reaches a position slightly beyond that shown at H both of the cords become slack allowing the golfer to follow through in any general type of position which is comfortable to him. Obviously as the slider 12 travels on around the guide 14 it will ultimately exert forces on the club when the cords become taut but at this point in time the swing has been completed and the forces will have no effect thereon.

From the foregoing it will thus be seen that apparatus constructed in accordance with the principles of this invention create a swing wherein maximum power is imparted to the club head by the golfer and/or by the slider to cause the club head to reach its maximum speed at the desired impact zone and at the exact point of impact while the club is traveling therethrough as a free "ballistic missile" but with the assurance that the club head assumes the proper attitude with respect to the line of flight to correctly strike the ball.

Figure 5:
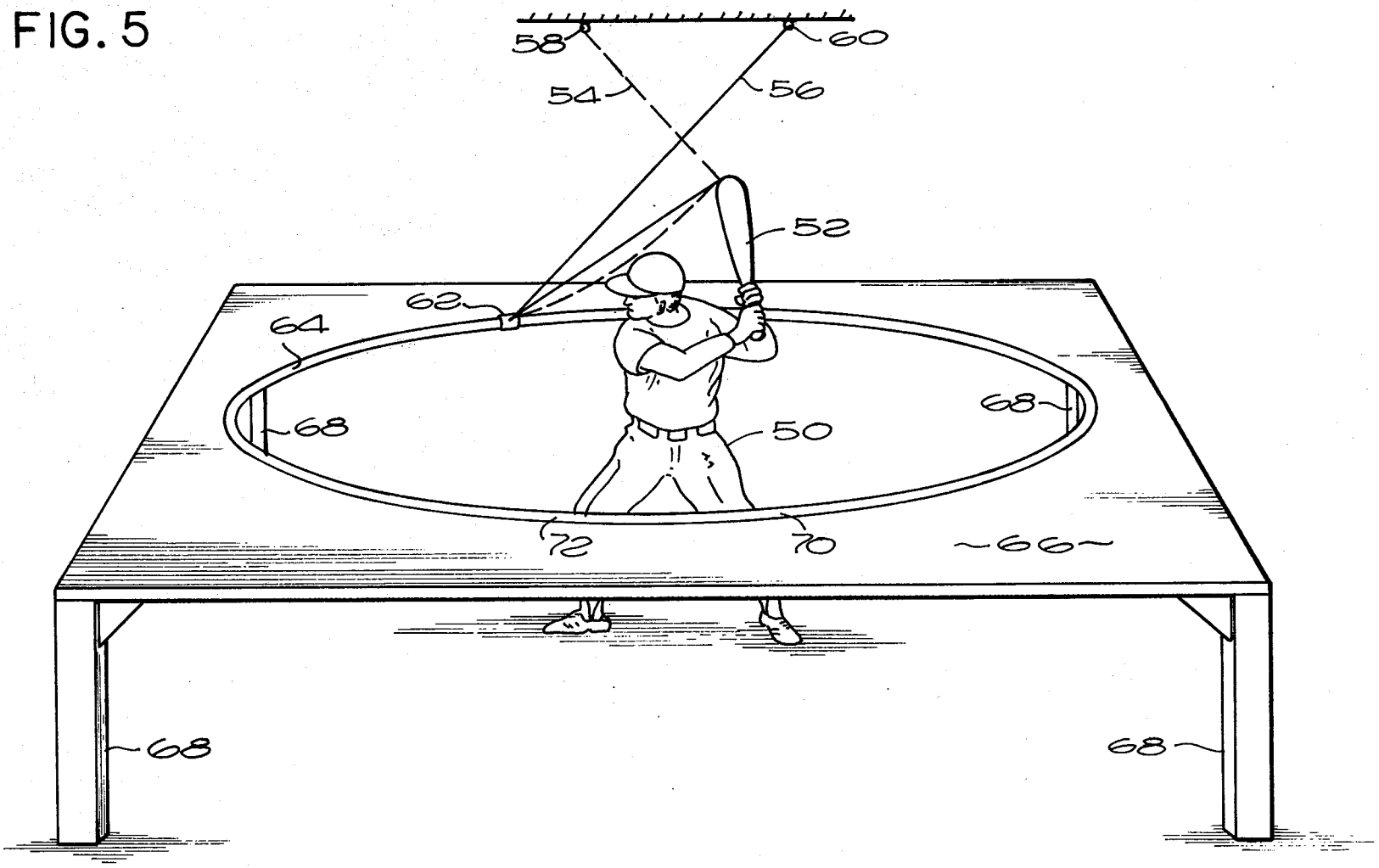
FIG. 5 is a schematic illustration of a baseball player in one position utilizing apparatus constructed in accordance with the principles of the present invention.

Referring now more particularly to FIG. 5 an alternative embodiment of the present invention is illustrated which may be utilized in conjunction with a teaching of a baseball type of swing. In FIG. 5 the user 50 is a baseball player holding bat 52. Cords 54 and 56 are attached to fixed points displaced from the user 50 and spaced apart as illustrated at 58 and 60. As is noted the cord 54 travels from the point 58 to the bat 52 and is then anchored to the slider 62 which is disposed upon the guide 64. Alternatively, the cord 56 travels from its point of attachment 60 to the slider 62 and is then secured to the bat 52. A guide means 64 is supported upon a frame 66 which is disposed above the surface upon which the player 50 stands by appropriate means such as the legs 68.

As will be recognized by those skilled in the art the batter 50 is in the classical position awaiting delivery of the baseball prior to striking the same as it passes through the impact or strike zone. That is, the baseball player is already in the same position as is the golfer at the top of the backswing. From this position then and by reference to FIGS. 2 and 3 with respect to the golfer it will be appreciated that as the player 50 moves the bat 52 from the position illustrated in FIG. 5 through the impact zone illustrated between points 70 and 72 in FIG. 5 this same sequence of events will occur causing the bat to develop maximum speed through the impact zone and assuring its proper position at that point in time to strike the ball.

Figure 6:
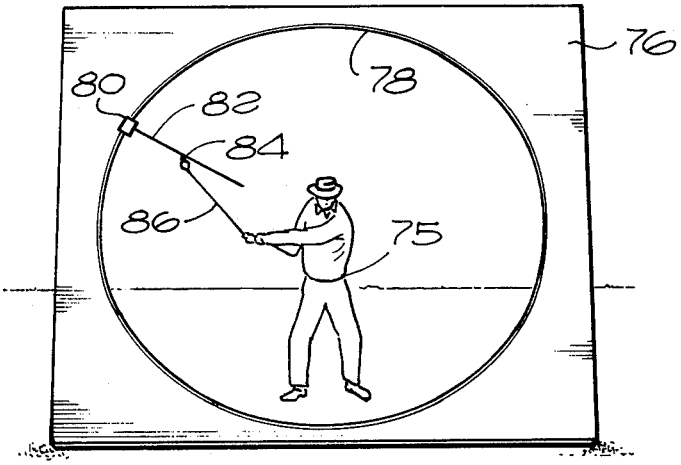
FIG. 6 is a schematic illustration of apparatus constructed in accordance with the present invention and utilizing an alternative embodiment of a portion thereof.

By reference now more particularly to FIG. 6 there is illustrated an alternative embodiment of the apparatus constructed in accordance with the present invention. As is therein shown a golfer 75 is again positioned within an apparatus supported by a frame 76 which includes thereon a guide 78 with a slider member 80 positioned to traverse the guide 78. Extending outwardly from the slider 80 is a solid rod 82. The rod 82 passes through a loop 84 positioned at the end of the golf club 86. As the golfer 75 travels through the classical swing, movement of the club 86 from the position of address such as that shown in FIG. 1 through the classical golf swing will cause the slider 80 to traverse the guide 78 as above described. By utilizing a loop 84 at the end of the golf club through which the solid rod 82 extends it will be recognized that the solid rod 82 functions in the same manner as do the cords 26 and 28 illustrated in FIGS. 1 through 4 to bring the club head into the impact zone at its maximum speed and proper position.

Figure 9:
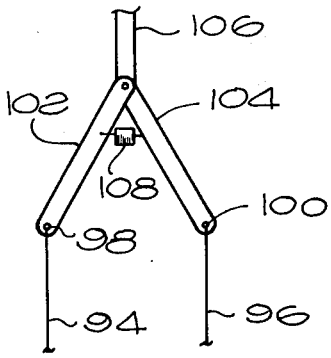
FIG. 7, 8 and 9 are schematic illustrations of an alternative embodiment of apparatus constructed in accordance with the present invention.
Figure 7:
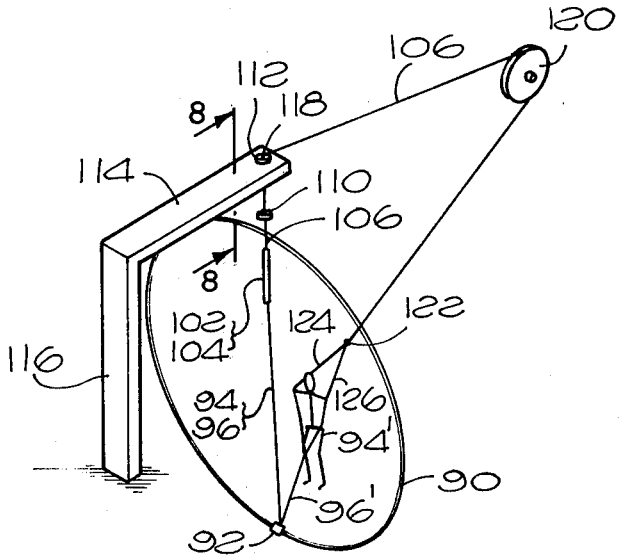
Figure 8:
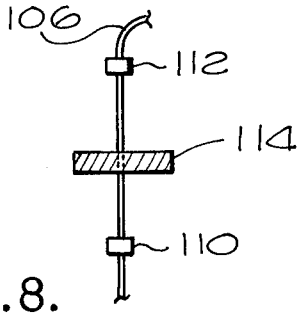

Referring now more specifically to FIGS. 7,8 and 9 there is illustrated a further embodiment of the invention constructed in accordance with the present invention. As is therein shown the guide 90 has a slider 92 positioned thereon and adapted to traverse the path defined by the guide 90. No specific support structure has been shown in FIG. 7 for the guide 90 but those skilled in the art will understand that such may be utilized as is appropriate for the particular guide employed. A golfer 94' is positioned with a golf club 96' in his hands. A pair of cords 94 and 96 (FIG. 9) are affixed at points 98 and 100 respectively to a pair of members 102 and 104 which are pivotally attached to a supporting structure such as a cord 106. A spring actuating member 108 is connected between the arms 102 and 104 to spread them apart into the position as shown in FIG. 9. In FIG. 7 the spring means 108 has been contracted and cocked in such a manner that the members 102 and 104 appear as a single member thus causing the cords 94 and 96 to appear as a single cord. Positioned above the member 106 is a first stop means 110 and a second stop means 112. The stops 110 and 112 are positioned on each side of a support member 114 which is positioned and held in place on an upright standard 116 appropriately anchored as illustrated. An opening 118 is provided in the member 114 through which the cord 106 passes. The cord 106 travels over a pulley 120 and separates at a point 122 into two cords 124 and 126 which are attached to the shoulders of the golfer 94 by any means desired such as a harness (not shown).

From a consideration of the apparatus as illustrated in FIGS. 7, 8 and 9 those skilled in the art will recognize that when the stop 112 abuts the support member 114 the cords 106, 94 and 96 are taut both to the slider 92 and to the shoulders of the golfer 94'. In this position the shoulders as well as the club have been positioned properly for the club to travel through the desired impact zone at the proper position. Thus it assures that the golfer has placed his shoulders in this position as opposed to lunging forward or leaning backward as the club is swung through the impact zone.

It will also be recognized that when the stop 110 is against the support member 114 the golfer has moved the club 96' from the address position to the top of the backswing and thus should move no further. Thus the golfer is given a signal that he is in the proper backswing position. Obviously between the stops 110 and 112 sufficient slack is provided to permit the golfer to swing from the address position to the top of the backswing and from the top of the backswing back through to the impact zone without interference.

From the foregoing description it will be recognized by those skilled in the art that as the golfer traverses the golf club from the address position as shown in FIG. 7 through the top of the backswing and then from that position through the impact zone not only will the golf club head be positioned properly and with maximum speed through the impact zone but simultaneously the golfers shoulders will be properly positioned. That is, if the golfer has moved ahead of the ball with his shoulders the apparatus will pull him back. If he's too far behind the ball he will be pulled forward. Subsequent to passage of the club head through the impact zone slack again develops in the cord 106 permitting the golfer to traverse through the followthrough as above described. Obviously similar attachments may be made to other portions of the golfer's body as may be desired to teach proper positions in the swing.

Figure 10:
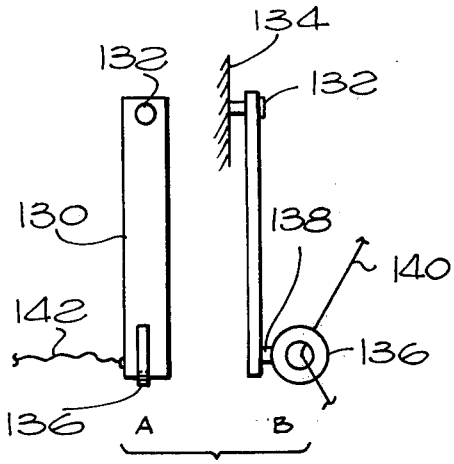
FIG. 10 is a schematic illustration of an alternative arrangement of a portion of apparatus constructed in accordance with the present invention.

Although the means for causing the weighted member to traverse a pre-determined path has in each instance been illustrated as a guide member with a slider 12 thereon it should be recognized that such may be replaced by equivalent structure such as that illustrated in FIG. 10 to which specific reference is hereby made. As is illustrated in FIG. 10 there is provided a rod 130 pivotally attached as shown at 132 to an appropriate support 134. At the opposite end of the rod 130 there is provided a ring 136 which is pivotally connected by the member 138 at the bottom of the rod 130. Thus the ring 136 may rotate or swivel relative to the rod 130 and the rod 130 may rotate about its pivot point 132. It should now be recognized by those skilled in the art that if a cord such as illustrated in 140 is passed through the swivel 136 as illustrated in FIG. 10-B and is appropriately anchored and connected to a device to be swung. The rod 130 and the ring 136 may then function as a guide and weighted slide as previously described with the identical results.

If desired one may also attach an additional cord such as is illustrated at 142 to the rod 130 or alternatively to the slider 12 as illustrated in the FIGS. 1 through 4. Through the utilization of such a cord an instructor working with a pupil utilizing apparatus in accordance with the present invention may apply additional force to the slider or to the rod 130 to cause it to speed up as it traverses the desired path thereby imparting additional speed to the club being swung by the user. Alternatively the instructor may apply a force to the cord 142 to slow down the swing and cause the user to go through it in slow motion. Such an additional structure could thus be utilized by an instructor when in his opinion the student was moving the club in such a fashion as to improperly develop maximum club head speed. Thus by imparting additional aiding or resisting power, force or speed to the weighted member (slider or rod) the movement of the club head could be properly corrected.

What is claimed is:

1. Swing Training Apparatus for perfecting timing of a device to be swung by a user thereof comprising:

A. A weighted member;

B. Means engaging said weighted member to direct said member through a pre-determined path as said device is swung;

C. A first flexible cord secured at one end, passing through said weighted member and anchored at the other end to said device for positioning said device in the proper attitude at that point in a swing where maximum speed of said device is attained;

D. A second flexible cord secured at one end, passing through said device and anchored to said weighted member for applying a force to said device during the power portion of a swing to accelerate said device through the point of desired maximum speed thereof; and E. Said first and second cords effectively releasing said device during that portion of said swing where maximum speed is attained while remaining in physical engagement therewith.

2. Swing Training Apparatus as defined in claim 1 wherein said first and second cords are secured at said one end to the shoulder area of said user.

3. Swing Training Apparatus as defined in claim 2 which further includes stop means allowing a pre-determined axial movement of said cords between first and second positions thereby to cause movement of said shoulders between proper impact and top of backswing positions.

4. Swing Training Apparatus as defined in claim 1 wherein said predetermined path directing means is a rod, means pivotally supporting said rod, said weighted member being affixed to said rod at a point displaced from the pivoted support thereof, ring means affixed to said rod, and said first flexible cord passing through said ring means.

5. Swing Training Apparatus as defined in claim 1 wherein said second and first flexible cords are taut at the beginning and end respectively of that portion of the swing where maximum speed of said device is attained and are both slack through said portion.

6. Swing Training Apparatus as defined in claim 1 wherein said one end of said first and second flexible cords are secured at points displaced from each other at least during that portion of said swing when maximum speed of said device is attained.

7. Swing Training Apparatus as defined in claim 6 which further includes first and second securing members, said one end of said first and second cords being affixed to said first and second securing means respectively.

8. Swing Training Apparatus for perfecting timing of the swing of a device to be swung by a user thereof comprising:

A. A weighted member;

B. Means engaging said weighted member to direct said member through a pre-determined path as said device is swung;

C. A flexible cord;

D. Means for anchoring one end of said cord;

E. Means for attaching the other end of said cord to said weighted member; and

F. Means for slidably attaching said cord, intermediate the ends thereof, to said device to be swung, whereby upon the user swinging said device, said weighted member traverses at least a portion of said pre-determined path.

9. Swing Training Apparatus as defined in claim 8 wherein said path determining means is an arcuate member adjustably disposed to accommodate users of varying physical sizes.

10. Swing Training Apparatus as defined in claim 9 wherein said weighted member is a slider slidably disposed relatively said arcuate member.

* * * * *